US006230673B1

(12) United States Patent
Sugimoto et al.

(10) Patent No.: US 6,230,673 B1
(45) Date of Patent: May 15, 2001

(54) SOLENOID-OPERATED VALVE FOR INTERNAL COMBUSTION ENGINE

(75) Inventors: Chihaya Sugimoto; Hisao Sakai; Kouichi Ikoma, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/440,669

(22) Filed: Nov. 16, 1999

(30) Foreign Application Priority Data

Nov. 26, 1998 (JP) ..... 10-336230

(51) Int. Cl.[7] ..... F01L 9/04

(52) U.S. Cl. ..... 123/90.11; 123/90.65; 251/129.15; 251/129.16

(58) Field of Search ..... 123/90.11, 90.65; 251/129.01, 129.15, 129.16

(56) References Cited

U.S. PATENT DOCUMENTS 4,715,332 * 12/1987 Kreuter ..... 123/90.11
5,131,624 * 7/1992 Kreuter et al. ..... 251/129.18
5,636,601 * 6/1997 Moriya et al. ..... 123/90.11
5,996,539 * 12/1999 Gobel et al. ..... 123/90.11
6,125,803 * 10/2000 Hattori et al. ..... 123/90.11

* cited by examiner

*Primary Examiner*—Weilun Lo
(74) *Attorney, Agent, or Firm*—Arent Fox Kintner Plotkin & Kahn

(57) ABSTRACT

A solenoid-operated valve for use in an internal combustion engine has a valve body movable upwardly for closing an exhaust or intake passage and movable downwardly for opening the exhaust or intake passage, a valve stem extending upwardly from the valve body, a pair of upper and lower solenoids spaced from each other in an axial direction of the valve stem and confronting each other vertically, the valve stem extending through the upper and lower solenoids, a movable plate mounted on the valve stem and disposed between the solenoids, the movable plate being movable between the solenoids to cause the valve stem to open and close the valve body in response to being magnetically attracted by the solenoids, a first spring for normally biasing the valve body to open the exhaust or intake passage, and a second spring for normally biasing the valve body to close the exhaust or intake passage against the first spring. The first spring has a resilient force greater than a resilient force of the second spring. The movable plate is positioned between an intermediate position between the upper and lower solenoids and the lower solenoid when the valve body biased by the first and second springs is in equilibrium.

2 Claims, 3 Drawing Sheets

SOLENOID-OPERATED VALVE FOR INTERNAL COMBUSTION ENGINE

BACKGROUND OF THE INVENTION

1. Field of the Invention

The present invention relates to a solenoid-operated valve for use in internal combustion engines which can be opened and closed under electromagnetic forces generated by solenoids or electromagnets.

2. Description of the Related Art

There have heretofore been known solenoid-operated valves for opening and closing exhaust passages in the cylinders of internal combustion engines under electromagnetic forces. The known solenoid-operated valves have a pair of solenoids or electromagnets confronting and spaced from each other, and a disk-shaped movable plate of magnetic metal disposed movably between the solenoids. The disk-shaped movable plate is fixed to the upper end of a valve stem which has a valve body on its lower end. The valve stem is slidably supported by and extends through an upper wall of an exhaust passage from an engine cylinder, with the valve body being positioned to selectively open and close the exhaust passage.

The disk-shaped movable plate is normally urged downwardly to open the exhaust passage by a spring positioned above the disk-shaped movable plate, and is also normally urged upwardly via the valve stem to close the exhaust passage by another spring positioned beneath the disk-shaped movable plate. The springs have equal resilient forces exerted to bias the disk-shaped movable plate in mutually confronting directions for thereby holding the disk-shaped movable plate intermediate between the solenoids.

When the exhaust stroke of the engine cylinder is completed, the upper solenoid is energized to magnetically attract the disk-shaped movable plate upwardly, so that the sum of the upward magnetic attractive force of the upper solenoid and the repelling force of the lower spring overcomes the biasing force of the upper spring thereby to displace the valve stem upwardly to cause the valve body to close the exhaust passage. When the exhaust stroke of the engine cylinder is started, the lower solenoid is energized to magnetically attract the disk-shaped movable plate downwardly, so that the sum of the downward magnetic attractive force of the lower solenoid and the biasing force of the upper spring overcomes the repelling force of the lower spring thereby to displace the valve stem downwardly to cause the valve body to open the exhaust passage.

At the start of the exhaust stroke of the engine cylinder, the internal pressure of the engine cylinder is relatively high and acts on the valve body in a direction to close the exhaust passage. Therefore, the valve body suffers a delay in its movement to open the exhaust passage, resulting in a failure to meet demands for higher rotational speeds and output power of the internal combustion engine.

One solution would be to increase the magnetic forces of the lower solenoid by supplying an increased current to the lower solenoid for thereby attract the diskshaped movable plate downwardly at an increased speed. However, the increased current supplied to the lower solenoid would be disadvantageous in that the solenoid-operated valve needs to have an increased power requirement.

SUMMARY OF THE INVENTION

It is therefore an object of the present invention to provide a solenoid-operated valve for use in internal combustion engines which is less susceptible to the internal pressure of an engine cylinder that is applied to a valve body when the exhaust passage thereof is opened, and which is prevented from suffering a delay in its movement to open the exhaust passage without an increase in the power requirement of a solenoid.

To achieve the above object, there is provided a solenoid-operated valve for use in an internal combustion engine, comprising a valve body movable upwardly for closing an exhaust passage and movable downwardly for opening the exhaust passage, a valve stem extending upwardly from the valve body, a pair of upper and lower solenoids spaced from each other in an axial direction of the valve stem and confronting each other vertically, the valve stem extending through the upper and lower solenoids, a movable plate mounted on the valve stem and disposed between the solenoids, the movable plate being movable between the solenoids to cause the valve stem to open and close the valve body in response to being magnetically attracted by the solenoids, a first spring for normally biasing the valve body to open the exhaust passage, and a second spring for normally biasing the valve body to close the exhaust passage against the first spring, the first spring having a resilient force greater than a resilient force of the second spring, the arrangement being such that the movable plate is positioned between an intermediate position between the upper and lower solenoids and the lower solenoid when the valve body biased by the first and second springs is in equilibrium.

In the following description, the resilient force represents a preset strength of each of the first and second springs, and the repelling force represents a biasing strength as it varies when each of the first and second springs is extended and compressed.

The solenoid-operated valve opens and closes the exhaust passage by enabling the solenoids to generate magnetic attractive forces in timed relation to the exhaust stroke of the internal combustion engine. Specifically, when the movable plate is attracted by the upper solenoid, the valve stem causes the valve body to close the exhaust passage, and when the movable plate is attracted by the lower solenoid, the valve stem causes the valve body to open the exhaust passage.

The valve body is vertically biased by the first spring and the second spring. When the solenoids are not energized, the valve body and the movable plate are held in a position in which the biasing forces from the first and second springs are in equilibrium. Since the resilient force of the first spring is greater than the resilient force of the second spring, when the biasing forces from the first and second springs are in equilibrium (when the solenoids are not energized), the movable plate is positioned below the intermediate position between the upper and lower solenoids, thus positioning the valve body below a central position between a closed position and an open position thereof (closer to the open position).

When the internal combustion engine discharges exhaust gases in its operation, the internal pressure of the cylinder acts in a direction to prevent the valve body in the closed position from being opened. While the valve body is closing the exhaust passage, i.e., while the movable plate is being attracted by the upper solenoid, the first spring is compressed a large distance and the second spring is compressed a small distance as it has nearly been fully extended, the repelling force of the first spring is large. When the movable plate stops being attracted by the upper solenoid and starts being attracted by the lower solenoid, the attractive force of the lower solenoid and the repelling force of the first spring move the movable plate smoothly to a position in which the biasing forces of the springs are in equilibrium, against the internal pressure of the cylinder acting on the valve body, thus moving the valve body to open the exhaust passage. When the movable plate moves past the position in which the biasing forces of the springs are in equilibrium, the repelling force of the second spring becomes progressively greater than the repelling force of the first spring. Inasmuch as the position in which the biasing forces of the springs are in equilibrium is below the central position between the solenoids (closer to the open position of the valve body), the valve body moves smoothly to the open position sufficiently against the internal pressure of the cylinder applied to the valve body.

According to the present invention, as described above, by simply using the first spring whose resilient force is greater than the resilient force of the second spring, the solenoid-operated valve is less susceptible to the internal pressure of the cylinder that is applied to the valve body when the exhaust passage is opened, and prevented from suffering a delay in its movement to open the exhaust passage without an increase in the power requirement of the lower solenoid.

The first spring has a resilient force selected to produce a biasing force greater than the internal pressure of the cylinder, which is applied in a direction to prevent the valve body from opening the exhaust passage, when the movable plate is moved from the intermediate position between the upper and lower solenoids to the position in which the valve body biased by the first and second springs is in equilibrium, and when the movable plate stops being attracted by the upper solenoid and starts being attracted by the lower solenoid, the valve body is moved continuously at a constant speed from the closed position to the open position thereof under the biasing force of the first spring for opening the exhaust passage.

Because the valve body is biased in an opening direction under biasing forces greater than the internal pressure of the cylinder by the first spring when the valve body is in the central position between the open and closed positions, the valve body is not prevented from being opened by the internal pressure of the cylinder, and can be opened at a constant speed.

The first spring has a resilient force selected to produce a repelling force when the valve body is in an open position, which is greater than a repelling force of the second spring when the valve body is in a closed position, and selected to produce a repelling force when the valve body is in the closed position, which is equal to a repelling force of the second spring when the valve body is in the open position.

In the case where the resilient forces of the springs are equal to each other as with the conventional solenoid-operated valve, the repelling forces of the first and second springs in the open and closed positions of the valve body do not differ from each other. The solenoids consume the same amount of electric energy when the movable plate is attracted by the upper solenoid and the first spring is compressed and when the movable plate is attracted by the lower solenoid and the second spring is compressed.

If the resilient force of the first spring were simply made greater than the resilient force of the second spring, it would be necessary to make the attractive force of the upper solenoid for attracting the movable plate to close the valve body, greater than the attractive force of the lower solenoid for attracting the movable plate to open the valve body. As a result, the upper solenoid would tend to have an increased power requirement.

According to the present invention, the resilient force of the first spring is selected such that the repelling force of the first spring when the valve body is in the closed position, i.e., when the movable plate is attracted by the upper solenoid and the first spring is compressed, is equal to the repelling force of the second spring when the valve body is in the open position, i.e., when the movable plate is attracted by the lower solenoid and the second spring is compressed. Therefore, even if the resilient force of the first spring is selected such that the repelling force of the first spring when the valve body is in the open position is greater than the repelling force of the second spring when the valve body is in the closed position, the attractive force of the upper solenoid to attract the movable plate can be rendered substantially equal to the attractive force of the lower solenoid to attract the movable plate, with the result that the upper solenoid is prevented from having an increased power requirement.

The solenoid-operated valve may be combined with an intake passage of the internal combustion engine. In such an application, the valve body may be movable upwardly for closing the intake passage and movable downwardly for opening the intake passage. Since the internal pressure of the cylinder is not applied to the valve body when the valve body is opened, the valve body can quickly be opened by the resilient force of the first spring which is greater than the resilient force of the second spring.

With the solenoid-operated valve combined with the intake passage, the first spring has a resilient force selected to produce a repelling force when the valve body is in an open position, which is greater than a repelling force of the second spring when the valve body is in a closed position, and selected to produce a repelling force when the valve body is in the closed position, which is equal to a repelling force of the second spring when the valve body is in the open position, so that the upper solenoid is prevented from having an increased power requirement.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
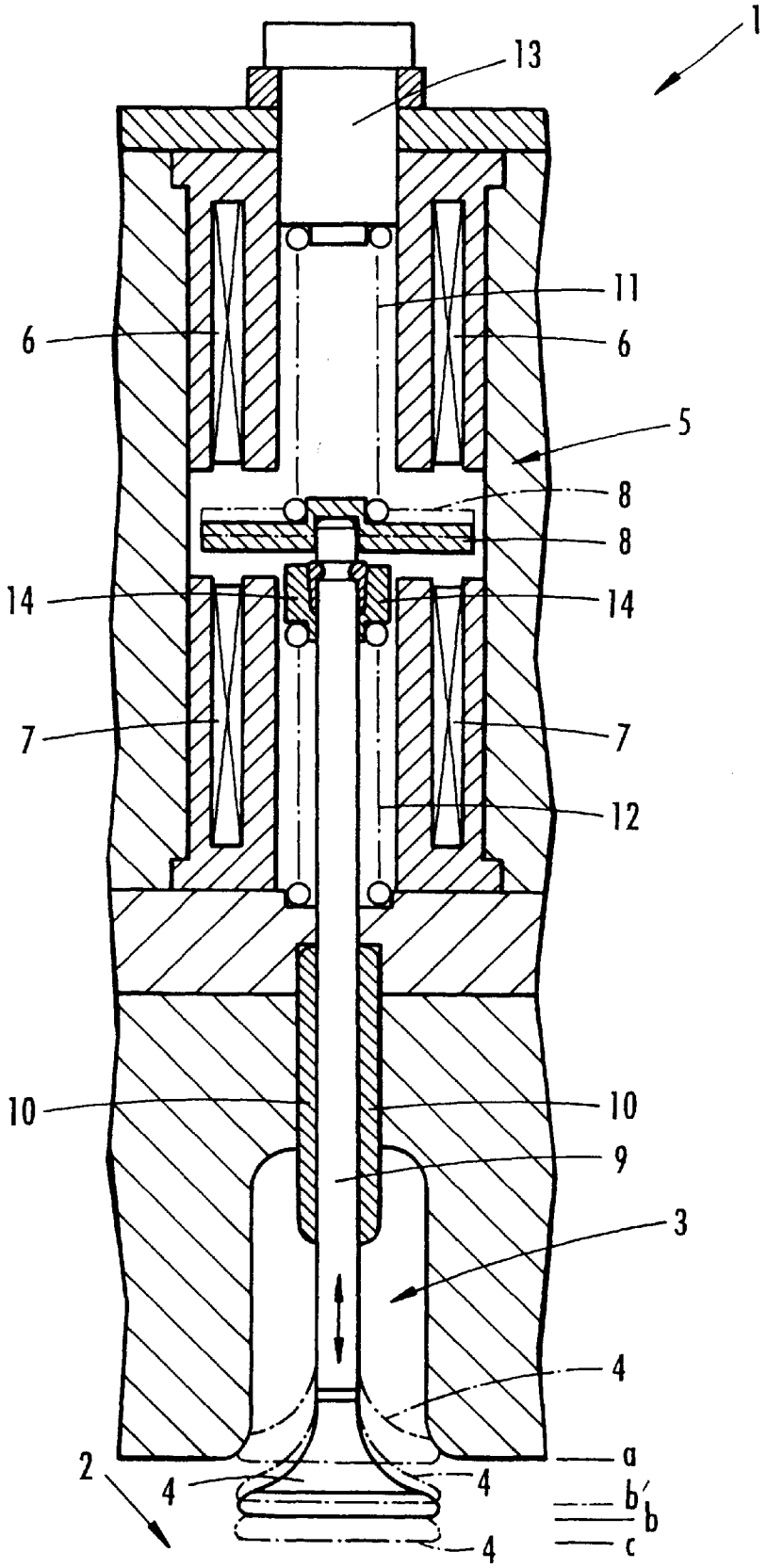
FIG. 1 is a longitudinal cross-sectional view of a solenoid-operated valve according to the present invention.

As shown in FIG. 1, a solenoid-operated valve 1 according to the present invention comprises a valve body 4 disposed for selectively opening and closing an exhaust passage 3 communicating with a cylinder 2 of an internal combustion engine, and an actuator 5 for actuating the valve body 4 to selectively open and close the exhaust passage 3.

The actuator 5 comprises a first cylindrical solenoid or electromagnet 6 disposed in an upper position, a second cylindrical solenoid or electromagnet 7 disposed in a lower position, and a movable plate 8 positioned between the first and second solenoids 6, 7 which are vertically spaced from and confront each other. The movable plate 8 is in the form of a disk made of magnetic metal, and can be moved vertically when magnetically attracted by the first and second solenoids 6, 7.

A valve stem 9 extends upwardly from the valve body 4, and the movable plate 8 is integrally coupled to the upper end of the valve stem 9. The valve stem 9 is slidably supported by and extends through a valve guide 10 disposed in an upper wall of the exhaust passage 3, and holds the valve body 4 in a position to selectively open and close the exhaust passage 3.

The first solenoid 6 houses therein a first spring 11 for normally biasing the movable plate 8 downwardly, and the second solenoid 7 houses therein a second spring 12 for normally biasing the movable plate 8 upwardly.

The first spring 11 is resiliently disposed between a spring holder 13 mounted on the upper end of the first solenoid 6 and an upper surface of the movable plate 8, for normally biasing the movable plate 8 downwardly. The second spring 12 is resiliently disposed between an inner wall surface of the lower end of the second solenoid 7 and a spring seat 14 fixed to the valve stem 9 below the movable plate 8, for normally biasing the movable plate 8 upwardly, for normally biasing the movable plate 8 upwardly via the valve stem 9. The first spring 11 applies a resilient force which is greater than the resilient force applied by the second spring 12.

Figure 2:
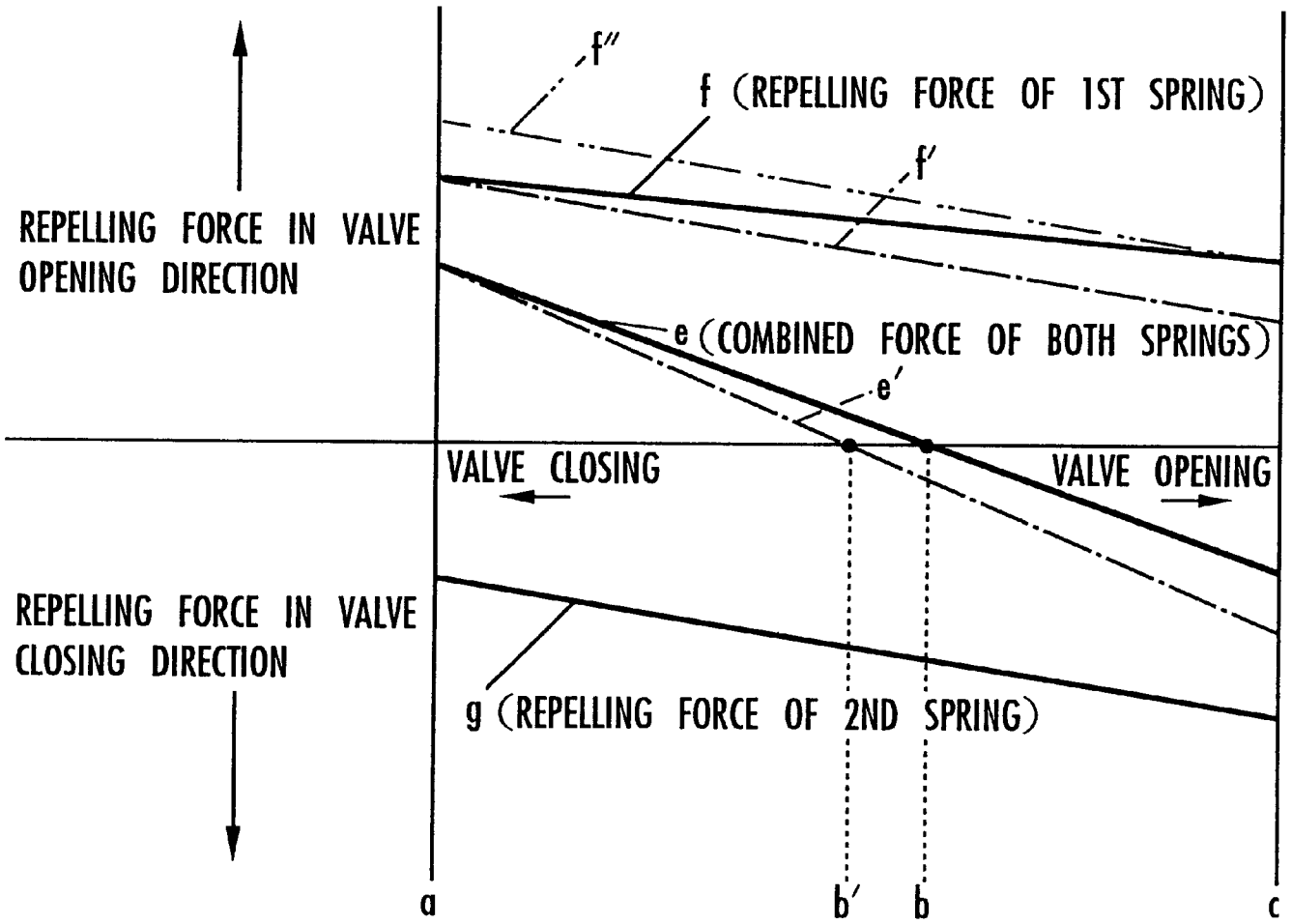
FIG. 2 is a diagram showing the manner in which the repelling forces of springs the solenoid-operated valve change.

FIG. 2 shows the relationship between repelling forces f, g, e based on the resilient forces of the first and second springs 11, 12 acting on the movable plate 8, and positions a, b, c of the valve body 4. FIG. 2 also shows, as a comparative example, a repelling force f' of the first spring 11 and a combined force e' of the first and second springs 11, 12 on the assumption that the first and second springs 11, 12 have equal resilient forces as with the conventional solenoid-operated valve, the forces f', e' being represented by the dot-and-dash-line curves. The positions a, b, c of the valve body 4 are shown in FIG. 2 because the movable plate 8 and the valve body 4 are movable in unison each other by the valve stem 9 and the position of the valve body 4 directly reflects the position of the movable plate 8.

In FIG. 2, the left-hand position a represents a closed position of the valve body 4 (which corresponds to the position of the valve body 4 indicated by a in FIG. 1), and the right-hand position c represents an open position of the valve body 4 (which corresponds to the position of the valve body 4 indicated by c in FIG. 1). A point where a boundary line across which the repelling force f of the first spring 11 and the repelling force g of the second spring 12 reverse each other in magnitude, i.e., a boundary between the repelling force in the direction to open the valve body and the repelling force in the direction to close the valve body, crosses the combined force e is a neutral position b of the valve body 4 where the biasing forces of the first and second springs 11, 12 are in equilibrium (which neutral position b corresponds to the position b of the valve body 4 in FIG. 1).

Because the resilient force of the first spring 11 is greater than the resilient force of the second spring 12, as shown in FIG. 2, the neutral position b of the valve body 4 is displaced toward the open position c of the valve body 4 from a neutral position b' (intermediate between the closed and open positions a, c of the valve body 4) under the combined force e' in the case where the first and second springs 11, 12 have equal resilient forces as with the conventional solenoid-operated valve.

The distance by which the neutral position b of the valve body 4 is displaced, i.e., the distance from the intermediate position b' to the neutral position b, can be changed by selecting the resilient force of the first spring 11. The repelling force f of the first spring 11 at each of the open and closed positions of the valve body 4 can also be selected.

As shown in FIG. 2, the resilient force of the first spring 11 is selected such that the repelling force f of the first spring 11 in the open position c of the valve body 4 is greater than the repelling force g of the second spring 12 in the closed position a of the valve body 4. At the same time, the resilient force of the first spring 11 is selected such that the repelling force f of the first spring 11 in the closed position a of the valve body 4 is equal to the repelling force g of the second spring 12 in the open position c of the valve body 4. With the resilient force of the first spring 11 being thus selected, the repelling force f of the first spring 11 in the closed position a of the valve body 4 is smaller than a repelling force f" of the first spring 11 which would be produced if the resilient force of the first spring 11 were simply made greater than the resilient force of the second spring 12. Consequently, the attractive force applied from the first solenoid 6 to the movable plate 8 to close the valve body 4 against the bias of the first spring 11 and the attractive force applied from the second solenoid 7 to the movable plate 8 to open the valve body 4 against the bias of the second spring 12 can be equalized to each other. Therefore, the power requirement of the first solenoid 6 can be made smaller than if the resilient force of the first spring 11 were simply greater than the resilient force of the second spring 12.

In order to make the resilient force of the first spring 11 greater than the resilient force of the second spring 12, the length of the first spring 11 may be made greater than the length of the second spring 12, or the diameter of the wire of the second spring 12 may be made smaller than the diameter of the wire of the first spring 11.

With the above arrangement, as shown in FIG. 1, the distance that the valve body 4 traverses from the neutral position to the open position is shorter than the distance that the valve body 4 traverses from the closed position to the neutral position, and the valve body 4 can quickly be opened at a constant speed from the closed position to the open position.

Figure 3:
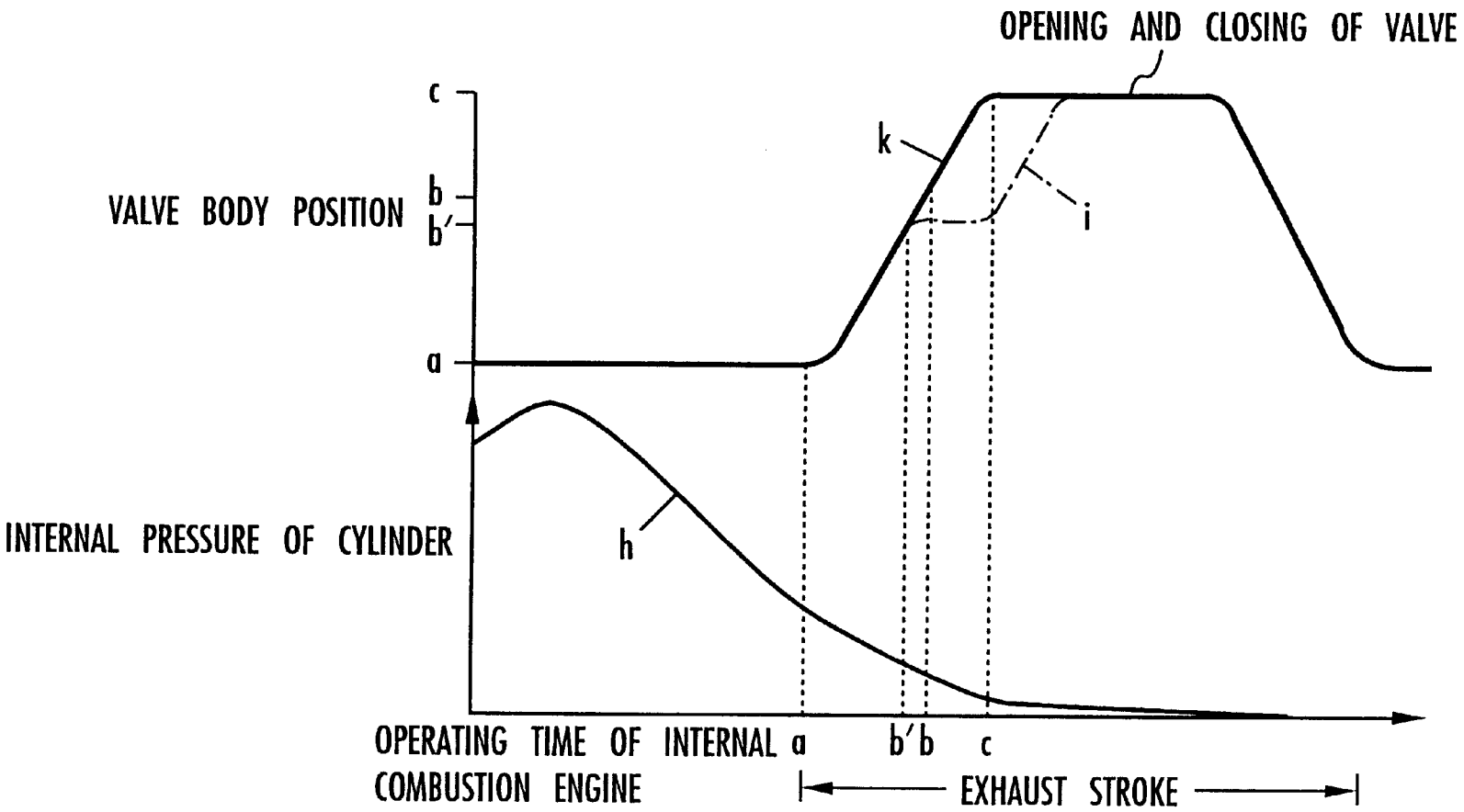
FIG. 3 is a diagram showing the manner in which a valve body of the solenoid-operated valve operates.

Operation of the solenoid-operated valve 1 will be described below with reference to FIGS. 1 through 3. As shown in FIG. 3, the solenoid-operated valve 1 opens the exhaust passage 3 to discharge exhaust gases from the cylinder 2 in synchronism with operation of the internal combustion engine. When the air-fuel mixture is combusted in the cylinder 2, the movable plate 8 is attracted by the first solenoid 6 to place the valve 4 in the closed position a thus closing the exhaust passage 3. Then, exhaust gases start being discharged from the cylinder 2. Specifically, the movable plate 8 stops being attracted by the first solenoid 6, and starts being attracted by the second solenoid 7. At this time, as shown in FIG. 3, the internal pressure h of the cylinder 2 which is being progressively lowered remains still high, presenting a resistance to the opening of the valve body 4. However, since the first spring 11 is compressed a large distance and the second spring 12 is compressed a small distance as it has nearly been fully extended, the repelling force f of the first spring 11 is much greater than the repelling force g of the second spring 12 (see FIG. 2). Therefore, until the valve body 4 moves from the closed position a to the neutral position b, the movable plate 8 is smoothly moved under the attractive force of the second solenoid 7 and the repelling force of the first spring 11 against the internal pressure of the cylinder 2 which is applied to the valve body 4.

In FIG. 3, if the first and second springs 11, 12 had equal resilient forces as with the conventional solenoid-operated valve, then the valve body 4 would move as indicated by the dot-and-dash-line curve i. With the conventional solenoid-operated valve, because the repelling force of the first spring 11 would be reduced when the valve body 4 would move from the closed position a to the intermediate position b', the valve body 4 would suffer a delay in its opening movement as indicated by the dot-and-dash-line curve i. In the illustrated embodiment according to the present invention, the repelling force of the first spring 11 in excess of the repelling force of the second spring 12 counteracts the internal pressure h of the cylinder 2 while the valve body 4 moves from the neutral position b' to the neutral position b. Thus, the valve body 4 moves through the neutral position b' without a delay in its opening movement, and is smoothly opened at a constant speed as indicated by the solid-line curve k in FIG. 3.

When the valve body 4 reaches the neutral position b, the repelling force of the first spring 11 is reduced. Since, however, the movable plate 8 is closer to the second solenoid 7 than heretofore in the neutral position b, the attractive force of the second solenoid 7 acts efficiently on the movable plate 8, enabling the valve body 4 to move smoothly to the open position c sufficiently against the internal pressure h of the cylinder 2.

While the solenoid-operated valve 1 is combined with the exhaust passage 3 of the internal combustion engine for smoothly discharging exhaust gases from the cylinder 2 in the illustrated embodiment, the solenoid-operated valve 1 may be combined with an intake passage (not shown) of the internal combustion engine. If the solenoid-operated valve 1 is combined with an intake passage, then the valve body 4 can be opened more quickly as the internal pressure of the cylinder 2 is not applied to the valve body 4 when the valve body 4 is opened.

Although a certain preferred embodiment of the present invention has been shown and described in detail, it should be understood that various changes and modifications may be made therein without departing from the scope of the appended claims.

What is claimed is:

1. A solenoid-operated valve for use in an internal combustion engine, comprising:

a valve body movable upwardly for closing a passage and movable downwardly for opening said passage, said passage being one of an exhaust passage and an intake passage;

a valve stem extending upwardly from said valve body;

a pair of upper and lower solenoids spaced from each other in an axial direction of said valve stem and confronting each other vertically, said valve stem extending through said lower solenoid;

a movable plate mounted on said valve stem and disposed between said solenoids, said movable plate being movable between said solenoids to cause said valve stem to open and close said valve body in response to being magnetically attracted by said solenoids;

a first spring for normally biasing said valve body to open said passage; and a second spring for normally biasing said valve body to close said passage against said first spring;

said first spring having a resilient force greater than a resilient force of said second spring, the arrangement being such that said movable plate is positioned between an intermediate position between said upper and lower solenoids and said lower solenoid when said valve body biased by said first and second springs is In equilibrium and said first spring has a resilient force selected to produce a repelling force when said valve body is in an open position, which is greater than a repelling force of said second spring when said valve body is in a closed position, and selected to produce repelling force when said valve body is in the closed position, which is equal to a repelling force of said second spring when said valve body is in the open position.

2. A solenoid-operated valve according to claim 1, wherein said first spring has a resilient force selected to produce a biasing force greater than an internal pressure of a cylinder communicating with said passage, which is applied in a direction to prevent said valve body from opening said passage, when said movable plate is moved from said intermediate position between said upper and lower solenoids to a position in which said valve body biased by said first and second springs is in equilibrium, and when said movable plate stops being attracted by said upper solenoid and starts being attracted by said lower solenoid, said valve body is moved continuously at a constant speed from a closed position to an open position thereof under the biasing force of said first spring for opening said passage.

* * * * *